United States Patent [19]

Atwater

[11] Patent Number: 4,796,303

[45] Date of Patent: Jan. 10, 1989

[54] KNEE PROTECTOR PAD

[75] Inventor: W. David Atwater, Yanceyville, N.C.

[73] Assignee: Royal Textile Mills, Inc., Yanceyville, N.C.

[21] Appl. No.: 124,020

[22] Filed: Nov. 23, 1987

[51] Int. Cl.[4] ..... A41D 13/00

[52] U.S. Cl. ..... 2/24

[58] Field of Search ..... 2/24

[56] References Cited

U.S. PATENT DOCUMENTS

| | | | |
|---|---|---|---|
| 2,188,718 | 1/1940 | Jung | 2/24 |
| 2,552,177 | 5/1951 | Hurt | 2/24 |
| 3,465,365 | 9/1969 | Jones et al. | 2/24 |
| 4,150,442 | 4/1979 | Boone | 2/24 X |
| 4,272,850 | 6/1981 | Rule | 2/24 |
| 4,333,181 | 6/1982 | Corriero | 2/24 |
| 4,484,361 | 11/1984 | Leighton et al. | 2/24 |
| 4,494,247 | 1/1985 | Kelly | 2/24 |
| 4,685,153 | 8/1987 | Sims | 2/24 |
| 4,756,026 | 7/1988 | Pierce | 2/24 X |

FOREIGN PATENT DOCUMENTS

| | | | |
|---|---|---|---|
| 0497128 | 10/1953 | Canada | 2/24 |

*Primary Examiner*—Louis K. Rimrodt

*Attorney, Agent, or Firm*—Bell, Seltzer, Park & Gibson

[57] ABSTRACT

This knee protector pad is particularly adapted for use by volleyball players and the like and includes an elastic sleeve enclosing the knee and adjacent portions of the leg of the wearer. A flat elastomeric foam pad is completely enclosed in a knit sleeve and bar tack stitching attaches spaced-apart portions of the upper and lower edges of the knit sleeve to the elastic sleeve to maintain the pad in position across the knee of the wearer and to maintain full stretchability of the elastic sleeve to facilitate doffing and donning of the knee protector pad. The foam pad has an elliptical configuration with a major axis extending transversely of the knee of the wearer and being of sufficient width to cover opposite sides of the knee, and a minor axis extending longitudinally of the knee and being substantially shorter than the major axis.

6 Claims, 1 Drawing Sheet

KNEE PROTECTOR PAD

FIELD OF THE INVENTION

This invention relates generally to a knee protector pad particularly suited for use by volleyball players and the like, and more particularly to such a knee protector pad including an elastic sleeve with a foam protective pad attached to the inner surface thereof, being of sufficient width to cover opposite sides of the knee, and being attached to the elastic sleeve by spaced-apart bar tack stitching to maintain full stretchability of the elastic sleeve when donning and doffing the protector pad.

BACKGROUND OF THE INVENTION

It is generally known to form a knee protective pad by attaching a foam cushioned member to an elastic sleeve adapted to encircle the leg of the wearer and to maintain the foam cushion pad in position on the knee of the wearer. For example, this general type of knee protector pad is shown in U.S. Pat. Nos. 2,188,718; 2,552,177; 4,272,850; and 4,484,361. In the knee protectors of each of these patents, the foam pad has a greater length than width and is held in position to protect primarily the front of the knee of the wearer. Also, with this type of knee protector the foam pad is held in position on the elastic sleeve by rows of stitching which tend to limit the stretchability of the elastic sleeve and thereby inhibit mobility as well as doffing and donning of the protector pad on the leg of the wearer. While opposite sides of the foam pads disclosed in U.S. Pat. Nos. 2,188,718 and 4,494,247 extend around opposite sides of the knee of the wearer, these foam pads are attached to the elastic sleeve in a manner which also significantly reduces the stretchability of the elastic sleeve and may also tend to restrict movement of the knee when taking part in active sports, such as playing volleyball.

SUMMARY OF THE INVENTION

With the foregoing in mind, it is an object of the present invention to provide a knee protector pad particularly adapted for use by volleyball players and the like and including an elastic sleeve supporting an elastomeric foam pad of sufficient width to cover and protect opposite sides of the knee and being attached to the elastic sleeve by spaced-apart bar tack stitching to maintain the pad in position and for maintaining full stretchability of the elastic sleeve to facilitate doffing and donning of the protector pad. The spaced-apart bar tack stitching does not unduly restrict the stretch characteristics of the elastic sleeve so that "one size fits all" sizing is permitted.

The knee protector pad of the present invention includes a substantially flat elastomeric foam pad having an elliptical configuration with a major axis extending transversely of the knee of the wearer and being of sufficient width to cover opposite sides of the knee, and a minor axis extending longitudinally of the knee and being substantially shorter than the major axis. The elastomeric foam pad is completely enclosed in a knit sleeve with lines of stitching extending across opposite ends of the knit sleeve. The knit sleeve enclosing the elastomeric foam pad is secured to the elastic sleeve by spaced bar tack stitching attaching upper and lower spaced-apart portions of the upper and lower edges of the knit sleeve to the elastic sleeve for maintaining the pad in the proper position across the knee of the wearer and for maintaining full stretchability of the elastic sleeve and yet providing freedom of movement of the leg during vigorous exercise or play.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENT

Figure 1:
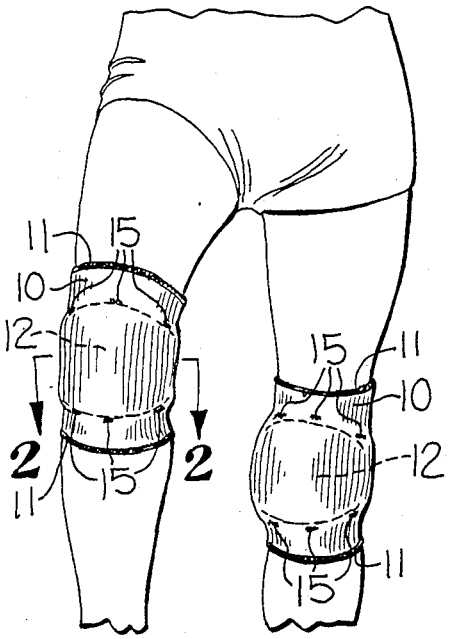
FIG. 1 is a perspective view of the present knee protector pad positioned on and covering the knee portions of each leg of the wearer.

As illustrated in the drawings, the present knee protector pad include an elastic sleeve 10 of textile fabric having sufficient length to cover the knee and adjacent portions of the calf and thigh of the wearer and having sufficient elasticity to snugly fit the area of the knee of the wearer. The elastic sleeve 10 has sufficient stretch characteristics that it will fit all sizes of wearers. The elastic sleeve is preferably seamless knit in a $1\times1$ rib knit construction with a covered elastic yarn inlaid in alternate courses of the knit sleeve. It is also preferred that the elastic sleeve 10 be wider at the upper end than the lower end and that it be gradually tapered downwardly during the knitting process. The relaxed elastic sleeve, in flattened and relaxed condition, is approximately $6\frac{1}{4}$ inches wide at the top and $5\frac{1}{4}$ inches wide at the bottom, and is $9\frac{1}{4}$ inches long. The upper and lower terminal ends of the elastic sleeve 10 may include an elastic tape incorporated in an overedge binder seam, as indicated at 11.

Figure 4:
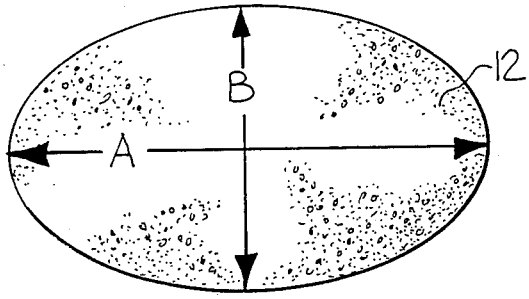
FIG. 4 is an elevational view of the elastomeric foam pad illustrating the elliptical configuration thereof.
Figure 6:
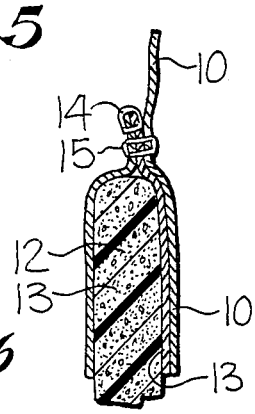
FIG. 6 is an enlarged vertical sectional view showing the manner in which the upper edge portion of the knit sleeve is attached to the elastic sleeve by bar tacking, being taken substantially along the line 6—6 in FIG. 5.

The knee protector pad also includes a substantially flat elastomeric foam pad, as illustrated at 12 in FIG. 4. The foam cushion pad 12 has a substantially elliptical configuration with a major axis, indicated at A, extending transversely of the knee of the wearer and being of sufficient width to cover opposite sides of the knee, and a minor axis, indicated at B, extending longitudinally of the knee and being substantially shorter than the major axis A. The foam pad 12 is preferably formed of $\frac{1}{2}$ inch thick polyurethane foam and the foam pad illustrated has a major axis A which is 9 inches and a minor axis B which is $5\frac{3}{4}$ inches. Thus, the major axis A is about one and one-half times as long as the minor axis B.

Figure 3:
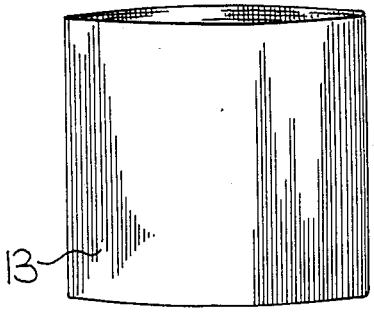
FIG. 3 is an elevational view of a knit sleeve of the type used to completely enclose the elastomeric foam pad.

A knit sleeve, indicated at 13 in FIG. 3, is provided for completely enclosing the elastomeric foam pad 12 therein and for attaching the same to the elastic sleeve 10, in a manner to be presently described. The knit sleeve 13 is preferably of the circular knit type and of a $1\times1$ rib construction. When in flattened and relaxed condition the knit sleeve 13 is 6 inches wide and 5½ inches long. The elastomeric foam pad 12 is enclosed in the knit sleeve 13 by inserting the foam pad 12 into the knit sleeve 13 and then forming an overedge seam, as indicated at 14 in FIG. 5, to close both the upper and lower ends of the knit sleeve 13.

Figure 5:
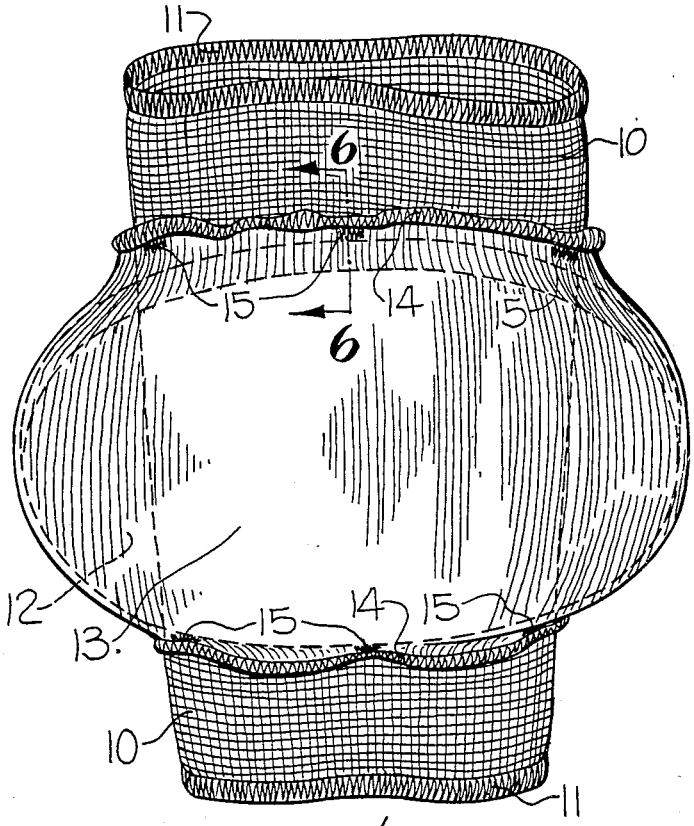
FIG. 5 is a perspective view of the present knee protector pad in everted condition and with the elastic sleeve in flattened condition.

The elastomeric foam pad 12, enclosed in the knit sleeve 13, is then attached to the elastic sleeve 10 by forming short spaced-apart bar tack stitching, indicated at 15 in FIG. 5, in spaced-apart positions along the upper and lower edges of the knit sleeve 13. The bar tack stitching 15 is provided in the three spaced positions along both the upper and lower edges of the knit sleeve 13. Bar tack stitching is positioned on opposite sides of the elastic sleeve 10, and in a position medially of the knit sleeve 13. The spaced-apart bar tack stitching 15 maintains the pad 12 in position on the inside of the elastic sleeve 10 so that the pad 12 is maintained in a position extending across and along opposite sides of the knee of the wearer. The bar tack stitching 15 also serves to maintain the full stretchability of the elastic sleeve when donning and doffing the protective pad.

Figure 2:
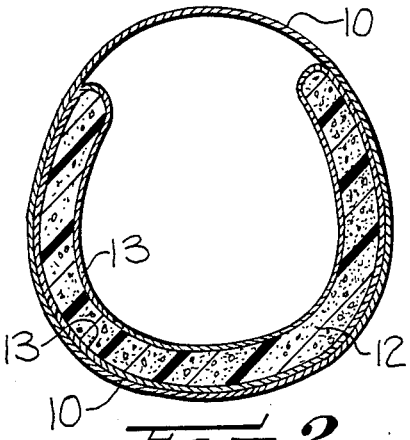
FIG. 2 is an enlarged somewhat schematic vertical sectional view taken substantially along the line 2—2 in FIG. 1.

After attaching the pad 12 and enclosing sleeve 13 to the elastic sleeve 10 in the manner described, the sleeve 10 is everted so that the pad is positioned within and attached to the inner surface of the sleeve 10 during use as seen in FIGS. 1 and 2. Thus in use, the sleeve 10 acts to hold the pad 12 in an arcuately curved configuration which overlies the front and opposite sides of the knee.

It is important that opposite sides of the knee of a volleyball player be protected by a cushioned pad because these portions of the wearer's leg frequently contact the floor and the cushioned pad aids in preventing injury to the wearer. Since the elastomeric foam pad 12 is first completely enclosed in the knit sleeve 13 and then the knit sleeve 13 is attached to the elastic sleeve by spaced-apart bar tack stitching 15, the normal stretchability of the elastic sleeve 10 is not limited so that the protector pad can be easily drawn onto and removed from the knee of the wearer. The spaced-apart bar tack stitching 15 does not unduly restrict the stretch characteristics of the elastic sleeve 10 so that "one size fits all" sizing of the knee protector pad is permitted. Also, the present protective pad does not unduly limit mobility of the knee joint of the wearer. While the foam pad 12 is illustrated as being attached to the medial portion of the elastic sleeve 10, it is to be understood that the foam pad 12 may be attached with its upper edge in close proximity to the upper edge of the elastic sleeve 10. In some instances, this arrangement may be used to provide increased comfort and greater mobility to the wearer.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A protector pad for cushioning and protecting the knee of a volleyball player and the like, said protector pad including:

an elastic sleeve of textile fabric having sufficient length to cover the knee and adjacent portions of the calf and thigh of the wearer and having sufficient elasticity to snugly fit the area of the knee of the wearer, a substantially flat elastomeric foam pad having an elliptical configuration with a major axis extending transversely of the knee of the wearer and being of sufficient width to cover opposite sides of the knee, and a minor axis extending longitudinally of the knee and being substantially shorter than said major axis, a knit sleeve completely enclosing said elastomeric foam pad and being closed by lines of stitching at opposite upper and lower edges thereof, said pad and said knit sleeve being positioned inside of said elastic sleeve, and spaced bar tack stitching attaching each of said upper and lower edges of said knit sleeve to said elastic sleeve to maintain said pad in a particular position inside of said elastic sleeve and across and along opposite sides of the knee of the wearer so that said elastic sleeve holds said pad in an arcuately curved configuration with said pad overlying the front and sides of the knee during use, and wherein said spaced bar tack stitching maintains full stretchability of said elastic sleeve when doffing and donning said protector pad.

2. A protector pad according to claim 1 wherein said bar tack stitching is positioned on opposite sides of said elastic sleeve, and in a position medially of said knit sleeve.

3. A protector pad according to claim 1 wherein said elastic sleeve is of a $1\times1$ rib knit construction and includes elastic yarn inlaid in alternate courses thereof.

4. A protector pad according to claim 1 wherein said knit sleeve is of a circular knit $1\times1$ rib construction.

5. A protector pad according to claim 1 wherein said major axis of said foam pad is about one and one-half times as long as said minor axis.

6. A protector pad according to claim 1 wherein said elastic sleeve is wider at one end than at the other end and gradually tapers in width therebetween.

* * * * *